US006044900A

United States Patent [19]

Kawahara

[11] Patent Number: 6,044,900

[45] Date of Patent: Apr. 4, 2000

[54] HEAT EXCHANGER WITH A RECEIVER

[75] Inventor: Tatsuhide Kawahara, Nishi-biwajima-machi, Japan

[73] Assignee: Mitsubishi Heavy Industries, Ltd., Tokyo, Japan

[21] Appl. No.: 09/288,010

[22] Filed: Apr. 8, 1999

Related U.S. Application Data

[62] Division of application No. 08/883,857, Jun. 27, 1997.

[51] Int. Cl.[7] ..... F25B 39/04

[52] U.S. Cl. ..... 165/110; 165/132; 165/176; 62/509

[58] Field of Search ..... 165/110, 132, 165/176; 62/509

[56] References Cited

U.S. PATENT DOCUMENTS

| | | | |
|---|---|---|---|
| 5,146,767 | 9/1992 | Kadle et al. | 62/474 |
| 5,379,833 | 1/1995 | Mathews | 165/113 |
| 5,546,761 | 8/1996 | Matsuo et al. | 62/509 |
| 5,628,206 | 5/1997 | Baba | 62/507 |
| 5,709,106 | 1/1998 | Inaba et al. | 62/509 |
| 5,875,650 | 3/1999 | Nobuta et al. | 62/509 |
| 5,884,503 | 3/1999 | Inaba | 62/509 |

*Primary Examiner*—Allen Flanigan
*Attorney, Agent, or Firm*—Eugene Lieberstein; Michael N. Meller

[57] ABSTRACT

There is provided a heat exchanger with a receiver which has a small diameter and compact size without a liquid refrigerant suction pipe.

The interior of a header tube 2 is partitioned into three chambers A, C, and F by partition plates 8*a* and 8*b*. The chamber C is provided with a refrigerant inlet 6, and the chamber F with a refrigerant outlet 7. Also, the interior of a header tube 3 is partitioned into chambers B, D, and E by partition plates 8*c* and 9. Receiver connecting flanges 11 are inserted in the side surface of the chambers B and E, and a receiver body 18 is fixed via receiver headers 21. An inlet passage 16 and an outlet passage 17 are formed in the receiver connecting flange 11 and the receiver header 21. A liquid refrigerant entering through the inlet passage 16 after passing through the chamber B drops in the receiver body 18 by gravity, and is conducted through the refrigerant outlet 7 after going through the outlet passage 17, chamber E, heat exchange tubes 4, and chamber F.

3 Claims, 8 Drawing Sheets

HEAT EXCHANGER WITH A RECEIVER

This application is a division of U.S. Pat. application Ser. No. 08/883,857 filed Jun. 27, 1997.

BACKGROUND OF THE INVENTION

1. Field of the Invention

The present invention relates to a heat exchanger well suitable to the use for a vehicular air conditioner condenser.

2. Description of the Related Art

FIG. 5 is a front view of a heat exchanger conventionally used for a vehicular air conditioner condenser, and FIG. 6 is a schematic refrigerant system diagram of a vehicular air conditioner. In these figures, the same reference numerals are applied to the same elements of the heat exchanger of the present invention.

As shown in FIG. 5, a heat exchanger 1 of this type has a pair of header tubes 2 and 3 at both sides, many heat exchange tubes 4 arranged in parallel to one another between these paired header tubes, and corrugated fins 5 interposed between the adjacent heat exchange tubes.

A refrigerant inlet 6 is provided at an upper position of one of the header tubes 2 and 3, for example, the header tube 2, a partition plate 8 is inserted in the central portion of the header tube 2 to partition the interior of the header tube 2 into upper and lower portions, and a refrigerant outlet 7 is provided at a lower position of the partitioned lower portion of the header tube 2.

In the above-mentioned heat exchanger 1, a high-pressure refrigerant compressed by a compressor (not shown) is sent to the header tube 2 through the refrigerant inlet 6 of the heat exchanger 1 after going through a high-pressure refrigerant hose, entering the upper portion of the header tube 2 partitioned by the partition plate 8, goes therefrom through the plural heat exchange tubes 4 arranged in parallel to one another, and enters the header tube 3.

From the header 3, the refrigerant goes through the plural heat exchange tubes 4 arranged in parallel one another in the same manner, is sent under pressure to the lower portion of the header tube 2 partitioned by the partition plate 8, and discharged through the refrigerant outlet 7. The refrigerant flowing in this manner is cooled by the corrugated fins 5 interposed between the adjacent heat exchange tubes in the process in which the refrigerant goes through the plural heat exchange tubes 4.

Generally, in the vehicular air conditioner, as shown in the schematic refrigerant system diagram of a vehicular air conditioner of FIG. 6, most of functional components composing the air conditioner are arranged in a vehicular engine room 101 subjected to a high temperature.

In FIG. 6, a refrigerant, which is sent under pressure from a compressor 103 that is mounted at the side of an engine 102 and driven by the engine 102 via a transmission belt, enters a condenser 1 through a high-pressure refrigerant hose 104.

The refrigerant, which is cooled by the condenser 1, goes out of the condenser 1 through a condenser refrigerant outlet 7, and is sent into a receiver 18 disposed in the vehicular engine room 101 through a refrigerant pipe 106 connecting the condenser refrigerant outlet 7 to a receiver inlet 181.

Then, the refrigerant goes out of the receiver 18 through a receiver outlet 185, goes through a refrigerant pipe 108, and is subjected to adiabatic expansion and is cooled by an expansion valve 109 disposed in a vehicular cabin. After being heated by an evaporator 110, the refrigerant is sucked by the compressor 103 through a low-pressure refrigerant hose 111. Thus, the cycle of this air conditioner is completed. In FIG. 6, reference numerals 161 and 162 denote a radiator and a radiator panel, respectively.

FIG. 7 shows the receiver 18. In this figure, reference numeral 181 denotes a refrigerant inlet, 182 denotes a desiccant, 183 denotes a filter, 184 denotes a refrigerant suction pipe, and 185 denotes a refrigerant outlet.

FIGS. 8 and 9 show an example of a conventional heat exchanger integral with a receiver. FIG. 9 is an enlarged view of the principal portion of FIG. 8.

In FIGS. 8 and 9, a heat exchanger 1 comprises a pair of header tubes 2 and 3 at both sides, many heat exchange tubes 4 arranged in parallel to one another between these paired header tubes, corrugated fins 5 interposed between the adjacent heat exchange tubes, and a receiver body 18.

The upper end of receiver body 18 is fixed to a receiver fixing bracket 10 mounted at the upper end or on the side surface at the upper position of the header tube 3 by means of fixing bolts 19, and the lower end thereof is directly connected to a receiver connecting flange 11 mounted ;at the lower position of the header tube 3 by means of fixing bolts 20, so that the receiver body 18 is configured so as to be integral with the heat exchanger 1.

The header tube 2 has a refrigerant inlet 6 at the upper position and a refrigerant outlet 7 at the lower position. Partition plates 8*a* and 8*b* are inserted and fixed into the header tube 2 between the refrigerant inlet 6 and the refrigerant outlet 7 with a proper space to partition a refrigerant passage in the header tube 2 into three chambers A, C, and F.

In the header tube 3, a partition plate 8*c* is inserted and fixed at a position corresponding to an approximately intermediate position of the space between the partition plates 8*a* and 8*b* in the header tube 2, so that a refrigerant passage in the header tube 3 is partitioned into chambers B and D. At the side of the chamber D of the header tube 3, refrigerant passage holes 12 and 13 are formed. The refrigerant passage holes 12 and 13 are partitioned in the header tube by a partition plate 9, so that a chamber E is formed under the partition plate 9 in the refrigerant passage of the header tube 3.

In the receiver connecting flange 11, which fits to the refrigerant passage holes 12 and 13 and connected to the header tube 3 by welding, a first refrigerant passage 14 communicating with the refrigerant passage hole 12 and a second refrigerant passage 15 communicating with the refrigerant passage hole 13 are formed. Also, the receiver connecting flange 11 has a flange surface through which the receiver body 18 is fixed by means of fixing bolts 20 via a receiver header 21, which is assembled and welded to the lower end of the receiver body 18 to form the receiver refrigerant inlet/outlet, and is threaded for the fixing bolts 20.

On the flange surface of the receiver connecting flange 11, a seal, such as an O-ring, is assembled to prevent leakage of refrigerant at the connection with the receiver header 21.

The respective receiver headers 21 are formed with a receiver inlet passage 16 and a receiver outlet passage 17. When the receiver header 21 is connected to the receiver connecting flange 11 of the header tube 3, the receiver inlet passage 16 communicates with the first refrigerant passage 14 of the receiver connecting flange 11, and the receiver outlet passage 17 communicates with the second refrigerant passage 15 of the receiver connecting flange 11.

The chamber E, which is formed at the lower portion in the header tube 3, is connected to the chamber F, which is formed at the lowest portion in the header tube 2, by plural heat exchange tubes arranged in parallel to one another at this portion between the header tubes, and the chamber F is provided with the refrigerant outlet 7 of the heat exchanger 1.

The refrigerant entering the receiver 18 through the receiver inlet passage 16 goes through a refrigerant suction pipe 184, filter 183, and desiccant 182, being conducted to the receiver outlet passage 17.

In the conventional receiver shown in FIGS. 7, 8, and 9, since it is necessary to make the refrigerant entering the receiver pass through the desiccant 182 to absorb water contained in the refrigerant with the desiccant and remove it, and it is also necessary to conduct the refrigerant at the receiver outlet, which is a liquid refrigerant accumulating at the lower part of the receiver, to a downstream expansion valve (not shown), the refrigerant suction pipe 184 is indispensable.

For this reason, the receiver is large in diameter and size because the refrigerant suction pipe 184 must be inserted, and the cost also increases.

An object of the present invention is to provide a heat exchanger with a receiver which has a small diameter and compact size without a liquid refrigerant suction pipe.

SUMMARY OF THE INVENTION

To solve the above problem, the present invention provides a heat exchanger with a receiver characterized in that a partition is provided on one end side of one header of a pair of headers, between which many heat exchange tubes are connected in parallel, to form a chamber communicating with a predetermined number of the heat exchange tubes, a refrigerant outlet is provided in the chamber and a refrigerant inlet is provided at other portion, a partition is provided at a position corresponding to the aforesaid partition on one end side of the other header to form chambers, by which a refrigerant flowing into one header through the refrigerant inlet is allowed to pass through the heat exchange tube at least one pass and conducted to the other end side of the other header, and a receiver, which is so configured that the receiver is connected to the other end side of the other header via an inlet passage and to the chamber on one end side via an outlet passage, by which the refrigerant entering from the inlet passage side drops by gravity, reaching the outlet passage side, is fixed to the other header.

A heat exchanger with a receiver in accordance with the present invention may be configured so that flanges are provided on one end side and the other end side of the other header, and the receiver is fixed between the flanges by means of bolts.

Also, the present invention provides a heat exchanger with a receiver, in which a flattened heat exchange tube, which preferably has a cross sectional form such that a plurality of refrigerant passages isolated by walls are formed, is subjected to serpentine molding, the heat exchanger with a receiver characterized in that a heat exchange tube positioned at the lowest position of the heat exchanger is separated from the upper heat exchange tube subjected to serpentine molding, a refrigerant outlet is provided at one end of the heat exchange tube positioned at the lowest position on one side of the heat exchanger, a refrigerant inlet is provided in the heat exchange tube above the refrigerant outlet, and a receiver, which is so configured that the receiver is connected to the upper end of upper heat exchange tube subjected to serpentine molding via an inlet passage and to the other end of heat exchange tube positioned at the lowest position via an outlet passage, by which the refrigerant entering from the inlet passage side drops by gravity, reaching the outlet passage side, is fixed to the other side of the heat exchanger.

A heat exchanger with a receiver in accordance with the present invention may be configured so that connecting tubes having a flange are provided at the upper end of the heat exchange tube subjected to serpentine molding and at the other end of the heat exchange tube positioned at the lowest position, and the receiver is fixed between the flanges of the connecting tubes by means of bolts.

Any heat exchanger with a receiver in accordance with the present invention may be configured so that a desiccant is filled into the receiver to adsorb water.

The heat exchanger with a receiver in accordance with the present invention, which is configured as described above, a refrigerant entering through the refrigerant inlet of the heat exchanger is cooled by corrugated fins interposed between the heat exchange tubes to turn to a liquid refrigerant, and introduced into the upper part of the receiver through the inlet passage on the side surface of the heat exchanger. The liquid refrigerant entering the receiver drops in the receiver by gravity, passes through the desiccant filled as necessary, and is stored at the lower part of the receiver.

This liquid refrigerant is discharged through the outlet passage at the lower end of the receiver, and further cooled by the corrugated fins while passing through the heat exchange tubes at the lower end of the heat exchanger. The refrigerant is supercooled, and goes out of the heat exchanger through the refrigerant outlet.

Thus, for the heat exchanger with a receiver in accordance with the present invention, the diameter and size of receiver can be made small, because the receiver of this type does not have a refrigerant suction pipe provided in the conventional receiver. In addition, a cost reduction can be achieved.

DETAILED DESCRIPTION OF PREFERRED EMBODIMENTS

Figure 1:
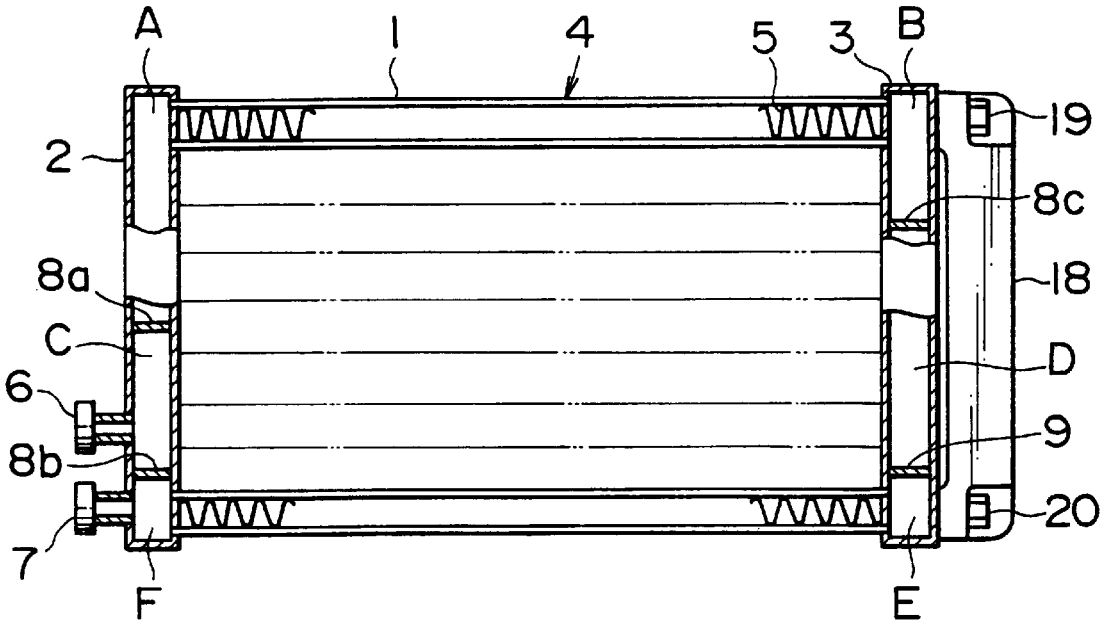
FIG. 1 is a front view of a heat exchanger in accordance with a first embodiment of the present invention.

A heat exchanger integral with a receiver in accordance with the present invention will be described in detail with reference to the embodiments shown in FIGS. 1 to 4. In the following embodiments, the same reference numerals are applied to the elements having the same configuration as that of the conventional elements shown in FIGS. 5 to 9.

(First embodiment)

Figure 2A:
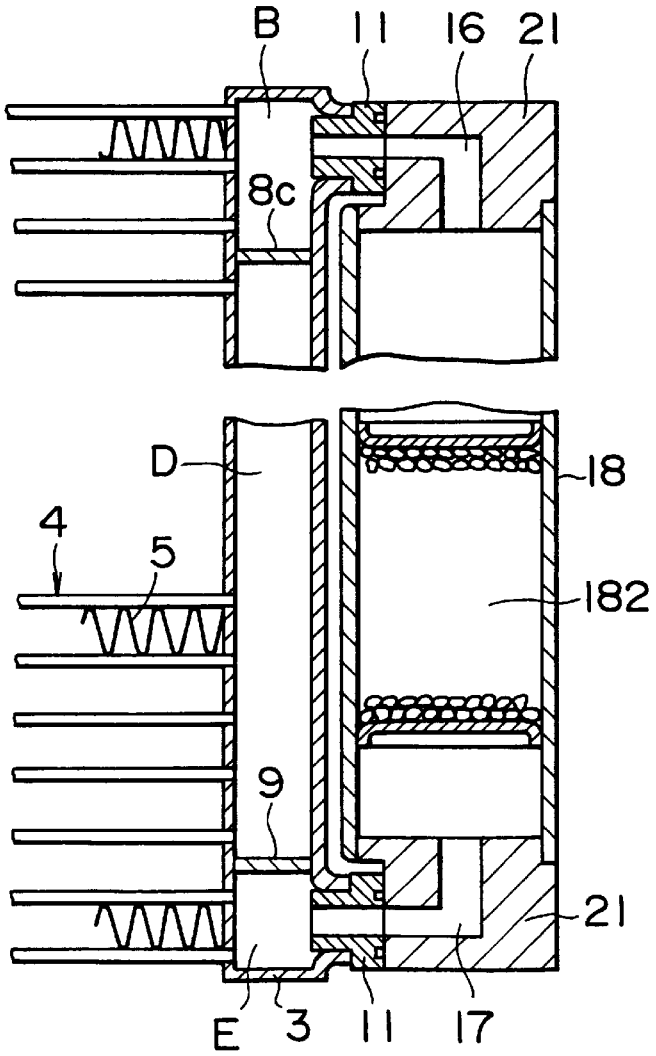
FIG. 2 is an enlarged view of the principal portion of the heat exchanger shown in FIG. 1, FIG. 2(*a*) being a sectional view, and FIG. 2(*b*) being a side view.
Figure 2B:
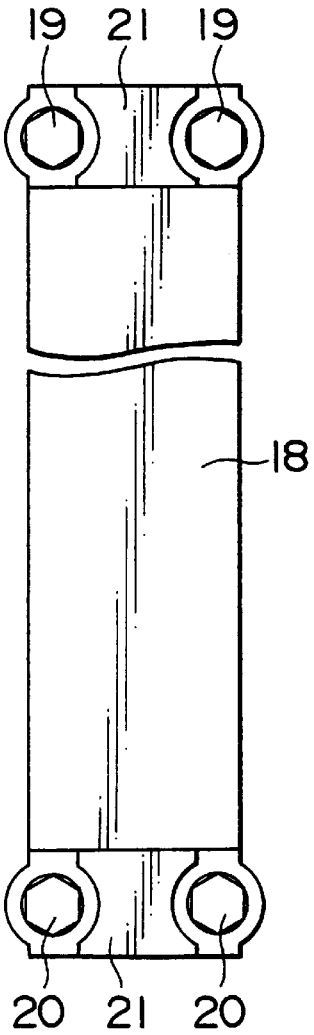

A first embodiment of the present invention is shown in FIGS. 1 and 2. FIG. 1 is a front view of a heat exchanger with a receiver of the first embodiment, and FIG. 2 is an enlarged view of the connecting portion between the heat exchanger and the receiver.

In FIGS. 1 and 2, a heat exchanger 1 is mainly composed of a pair of header tubes 2 and 3 at both sides, many heat exchange tubes 4 arranged in parallel to one another between these paired header tubes, corrugated fins 5 interposed between the adjacent heat exchange tubes, and a receiver body 18 installed to the header tube 3.

The upper end of receiver body 18 is fixed to a receiver connecting flange 11 mounted at the upper position of the header tube 3 by means of fixing bolts 19, and the lower end thereof is directly connected to a receiver connecting flange 11 mounted at the lower position of the header tube 3 by means of fixing bolts 20, so that the receiver body 18 is configured so as to be integral with the heat exchanger 1.

The header tube 2 is provided with a refrigerant outlet 7 at the lower position thereof and a refrigerant inlet 6 just above the refrigerant outlet 7. Partition plates 8*a* and 8*b* are inserted and fixed to partition the refrigerant passage in the header tube 2 into three chambers A, C, and F. The refrigerant inlet 6 is installed to the chamber C, and the refrigerant outlet 7 to the chamber F, the inlet and outlet communicating with one another. In the header tube 3, a partition plate 8*c* is inserted and fixed at the intermediate position between the partition plate 8*a* in the header tube 2 and the upper end, and a partition plate 9 is inserted and fixed at the lower position, so that the refrigerant passage in the header tube 3 is partitioned into chambers B, D, and E.

The receiver connecting flange 11 is inserted in the side surface of the chambers B and E, and the receiver body 18 is fixed to the header 3 via receiver headers 21 by means of the fixing bolts 19 and 20. The receiver connecting flange 11 and the receiver header 21 are formed with a receiver inlet passage 16 and a receiver outlet passage 17 as refrigerant passages. Also, an O-ring is installed between the receiver connecting flange 11 and the receiver header 21 to prevent leakage of refrigerant.

In this heat exchanger integral with the receiver, a refrigerant entering through the refrigerant inlet 6 goes into the chamber B through the chamber C, heat exchange tubes 4, chamber D, heat exchange tubes 4, chamber A and heat exchange tubes 4. During this process, the refrigerant is heat exchanged to turn to a liquid. The refrigerant goes through the receiver inlet passage 16, enters the receiver body 18, drops therein by gravity, passes through the desiccant 182, receiver outlet passage 17, and chamber E, is supercooled in the heat exchange tubes 4, and conducted to the refrigerant outlet 7 through the chamber F.

(Second embodiment)

Figure 3:
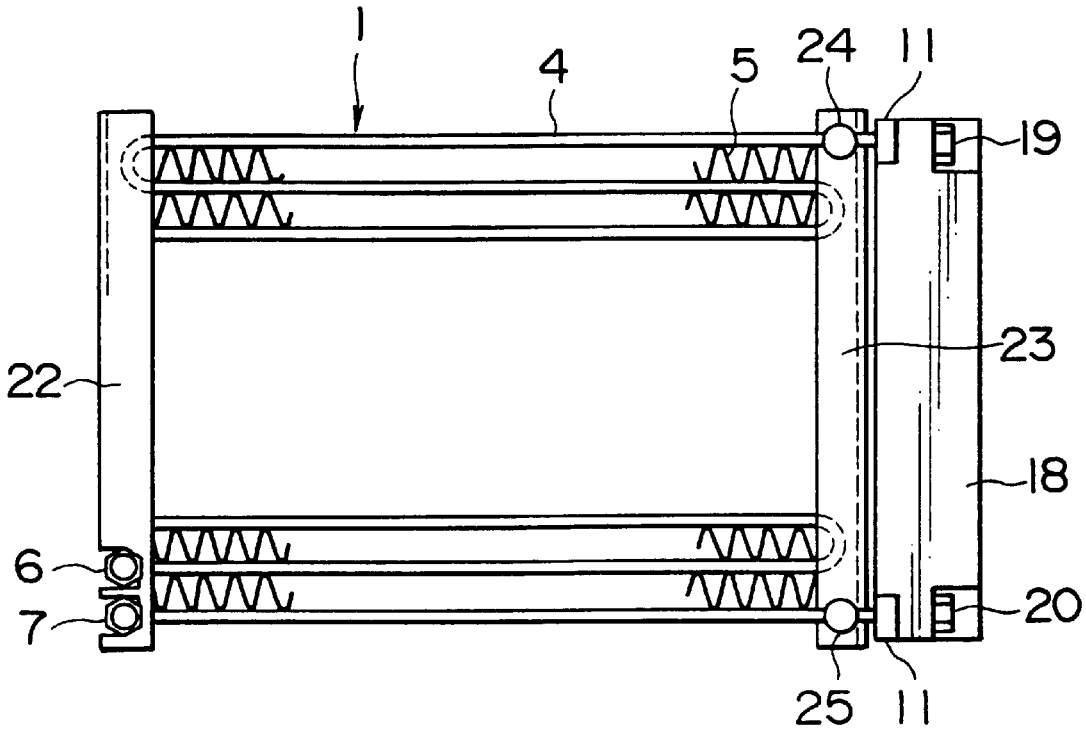
FIG. 3 is a front view of a heat exchanger in accordance with a second embodiment of the present invention.
Figure 4A:
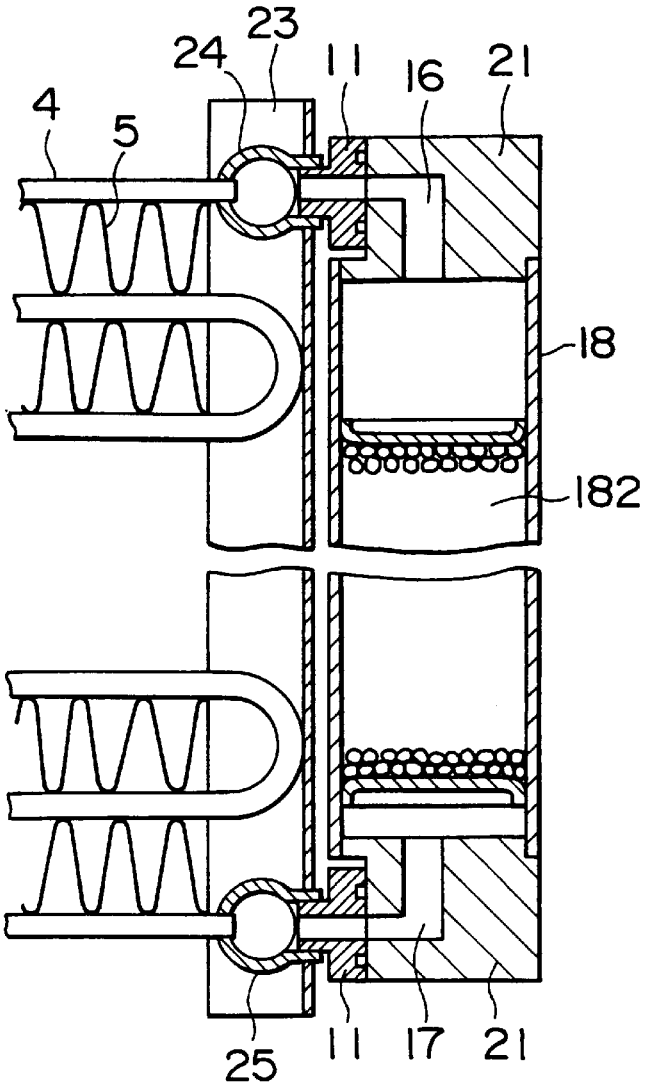
FIG. 4 is an enlarged view of the principal portion of the heat exchanger shown in FIG. 3, FIG. 4(*a*) being a sectional view, and FIG. 4(*b*) being a side view.
Figure 4B:
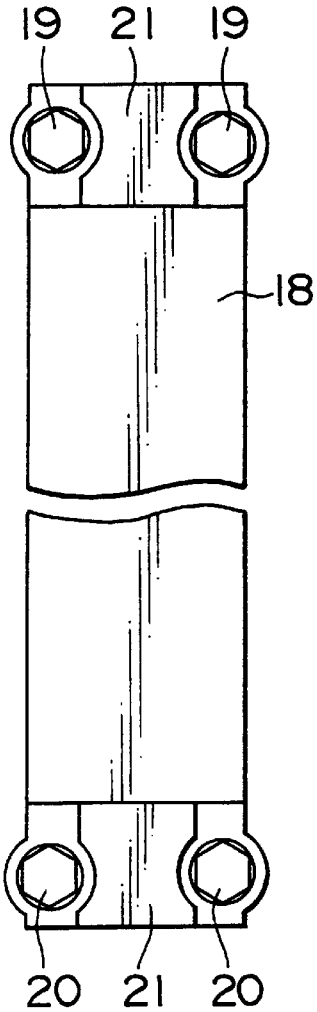
Figure 5:
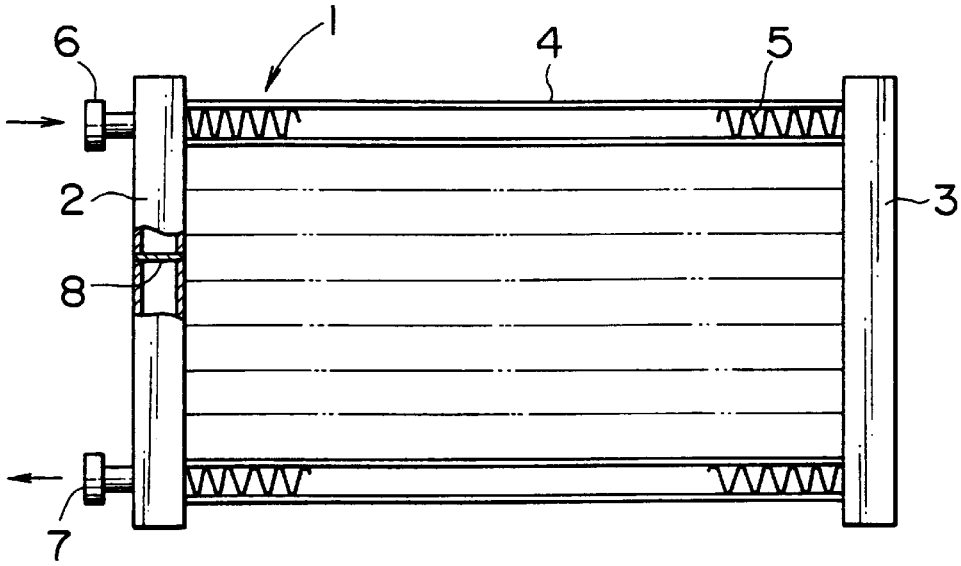
FIG. 5 RELATED ART
FIG. 5 is a front view of a conventional heat exchanger.
Figure 6:
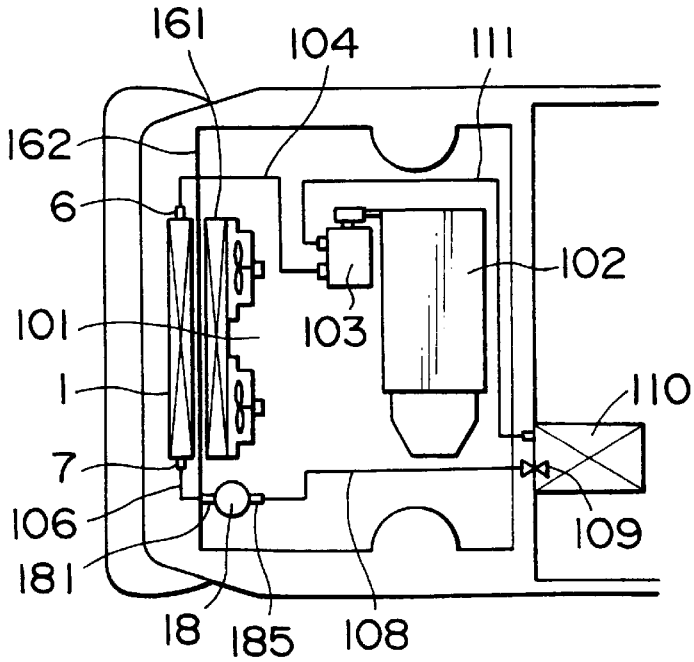
FIG. 6 RELATED ART
FIG. 6 is a schematic refrigerant system diagram of a conventional vehicular air conditioner.
Figure 7:
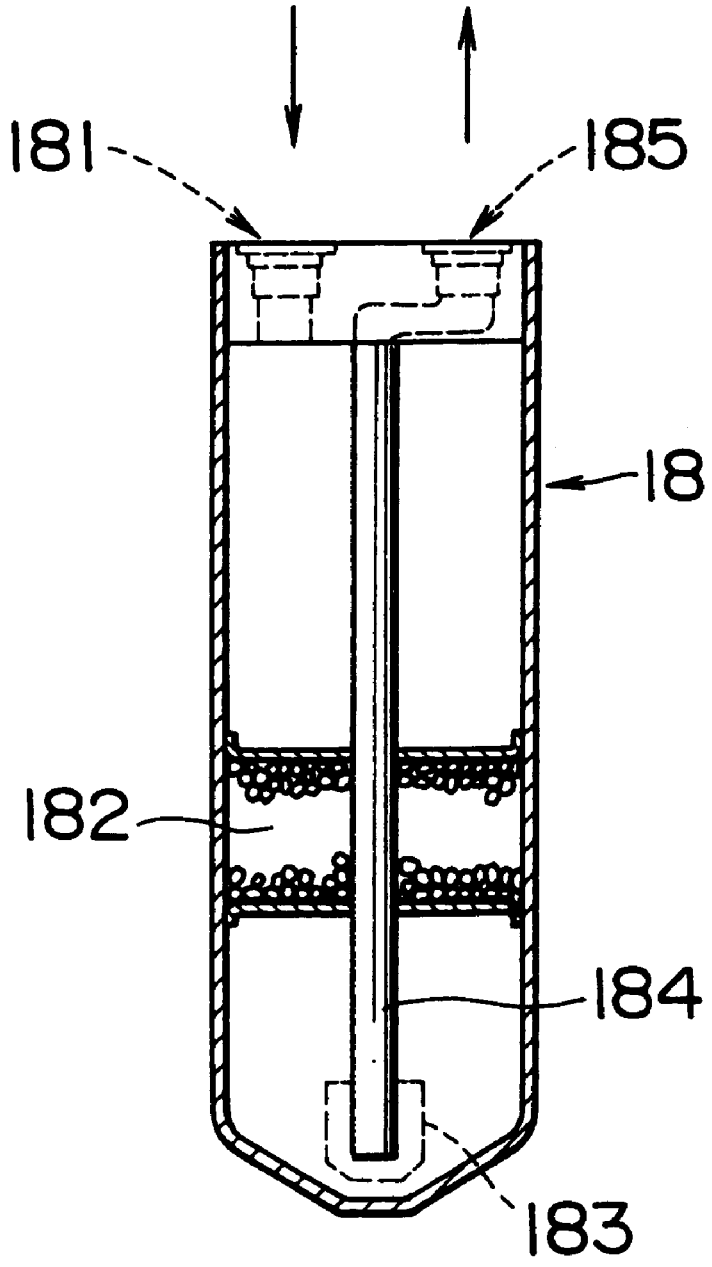
FIG. 7 RELATED ART
FIG. 7 is a sectional view showing a construction of a conventional receiver.
Figure 8:
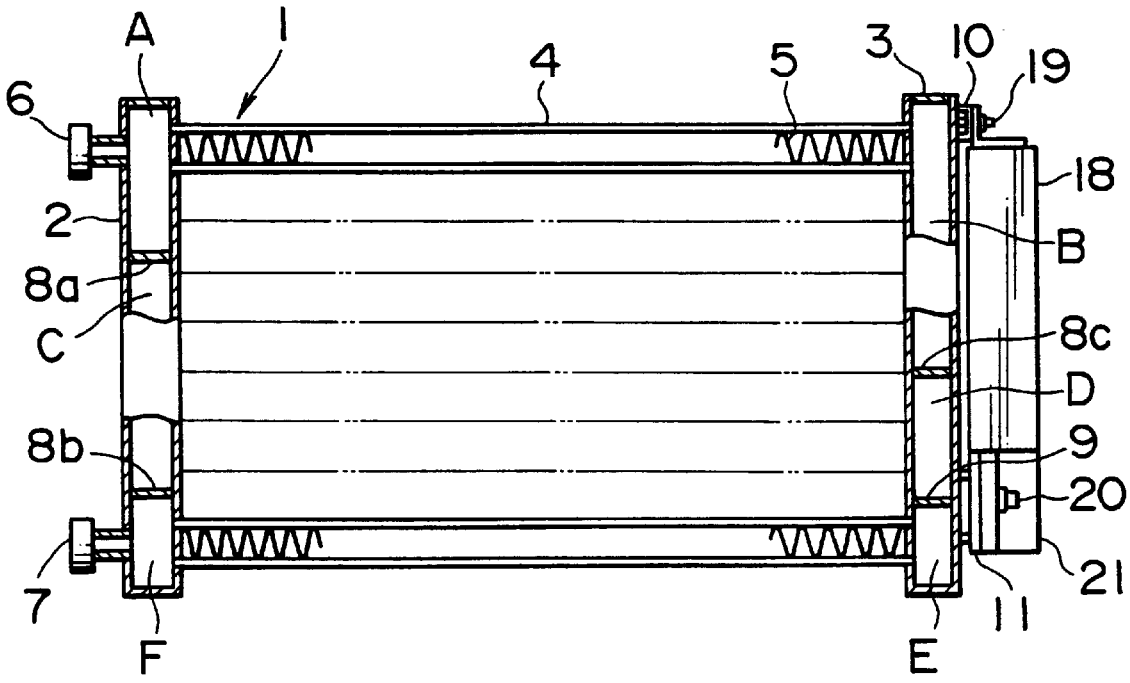
FIG. 8 RELATED ART
FIG. 8 is a front view of a conventional heat exchanger integral with a receiver.
Figure 9B:
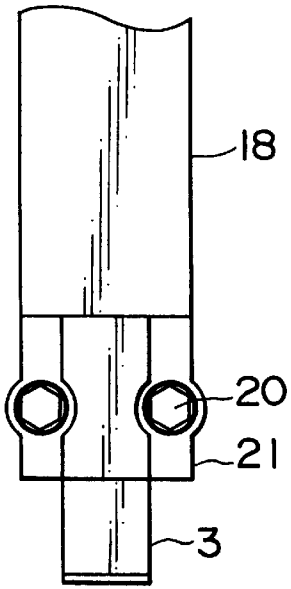
FIG. 9b RELATED ART
FIG. 9 is an enlarged view of the principal portion of the heat exchanger shown in FIG. 8, FIG. 9(*a*) being a sectional view, and FIG. 9(*b*) being a side view.
Figure 9A:
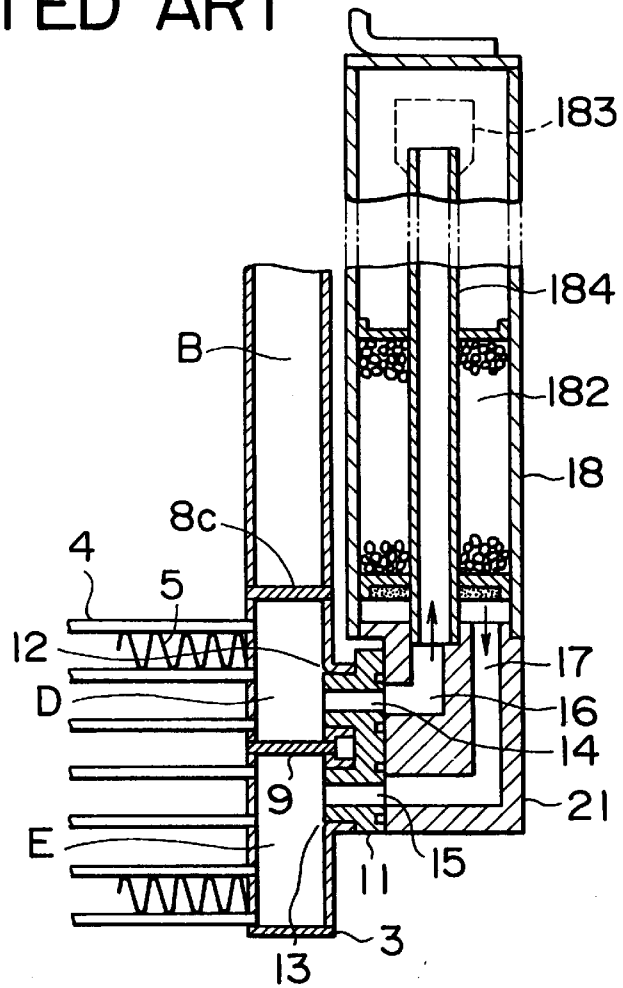
FIG. 9a RELATED ART

A second embodiment of the present invention is shown in FIGS. 3 and 4. FIG. 3 is a front view of a heat exchanger with a receiver of the second embodiment, and FIG. 4 is an enlarged view of the connecting portion between the heat exchanger and the receiver.

This heat exchanger 1 comprises heat exchange tubes 4, which are formed by serpentine molding a flattened tube subjected to continuous extrusion molding as shown in FIG. 3, corrugated fins 5 interposed between the adjacent heat exchange tubes 4, and side channels 22 and 23 assembled to maintain the rigidity of the heat exchanger 1. A receiver body 18 is connected to the side channel 23 by fastening receiver headers 21 integral with the receiver body 18, connecting tubes 24 and 25 connected to the end of the heat exchange tube 4, and receiver flanges 11 inserted in the connecting tubes 24 and 25 by means of bolts 19 and 20, respectively.

In this heat exchanger integral with the receiver, a refrigerant entering through a refrigerant inlet 6 is cooled while passing through the heat exchange tube 4 to turn to a liquid. Then, the refrigerant goes through the connecting tube 24 and a receiver inlet passage 16 formed in the receiver connecting flange 11 and the receiver header 21, and enters the receiver body 18.

The liquid refrigerant drops by gravity, passes through a desiccant 182, and is stored at the lower part of the receiver body 18. The liquid refrigerant goes through a receiver outlet passage 17, formed in the receiver header 21 and the receiver connecting flange 11, and the connecting tube 25, is supercooled by the heat exchange tube 4, and conducted to a refrigerant outlet 7.

As described above, in the heat exchanger with a receiver in accordance with the present invention, the receiver, which communicates with the heat exchanger via the inlet passage at the upper part and the outlet passage at the lower part, is integrally fixed to the side of the heat exchanger. A refrigerant entering through the refrigerant inlet of heat exchanger is heat exchanged by the corrugated fins interposed between the heat exchange tubes to turn to a liquid refrigerant, goes through the inlet passage at the upper part of the side of the heat exchanger, and is conducted to the upper part of the receiver.

The liquid refrigerant drops in the receiver by gravity, and is stored at the lower part of the receiver. This liquid refrigerant is conducted through the outlet passage at the lower end of the receiver, and further heat exchanged by the corrugated fins while going through the heat exchange tubes at the lower end of the heat exchanger. The refrigerant is supercooled, and goes out of the heat exchanger through the refrigerant outlet.

With the receiver which is integral with the heat exchanger having the above-mentioned construction, the diameter and size of receiver can be made small, because the receiver of this type does not have a refrigerant suction pipe provided in the conventional receiver. In addition, a cost reduction can be achieved.

I claim:

1. A heat exchanger with a receiver, said heat exchanger comprising a plurality of parallel heat exchange tubes connected between first and second headers, said tubes and said headers being adapted to have refrigerant flowing therethrough and a plurality of fins arranged between said heat exchange tubes, said heat exchanger with a receiver further comprising a first partition mounted in said first header to form a first chamber communicating with a predetermined of said heat exchange tubes, a refrigerant outlet arranged in a first portion of said chamber and a refrigerant inlet arranged in a second portion of said chamber adjacent said refrigerant outlet, a second partition arranged in said second header to form a plurality of second chambers whereby a refrigerant flowing into said first header through said refrigerant inlet is allowed to pass through said heat exchange tubes and is conducted to said second header, and a receiver connected to said second header, said receiver having an upper end containing an inlet passage communicating with one of said second chambers and a lower end containing an outlet passage communicating with one of said second chambers whereby any, refrigerant entering said inlet passage side of said receiver drops by gravity, reaching said outlet passage thereof.

2. A heat exchanger with a receiver according to claim 1, wherein flanges are provided on said second header, and said receiver is fixed between said flanges.

3. A heat exchanger with a receiver according to claim 1, wherein a desiccant is filled into said receiver to absorb water.

* * * * *